US011668155B2

(12) United States Patent
Sherman et al.

(10) Patent No.: US 11,668,155 B2
(45) Date of Patent: Jun. 6, 2023

(54) BOP STUMP TEST APPARATUS

(71) Applicant: NEXUS ENERGY TECHNOLOGIES INC., Red Deer (CA)

(72) Inventors: Scott Sherman, Blackie (CA); James Barnes, Red Deer (CA); Shayne Musseau, Red Deer (CA)

(73) Assignee: NXL TECHNOLOGIES INC., Red Deer County (CA)

( * ) Notice: Subject to any disclaimer, the term of this patent is extended or adjusted under 35 U.S.C. 154(b) by 121 days.

(21) Appl. No.: 17/444,738

(22) Filed: Aug. 9, 2021

(65) Prior Publication Data

US 2022/0049567 A1 Feb. 17, 2022

Related U.S. Application Data

(60) Provisional application No. 63/066,441, filed on Aug. 17, 2020.

(51) Int. Cl.
*E21B 33/06* (2006.01)
*E21B 47/06* (2012.01)

(52) U.S. Cl.
CPC ..... *E21B 33/062* (2013.01); *E21B 47/06* (2013.01)

(58) Field of Classification Search
CPC ..... E21B 33/062; E21B 33/06
See application file for complete search history.

(56) References Cited

U.S. PATENT DOCUMENTS

| | | | | |
|---|---|---|---|---|
| 4,580,628 | A * | 4/1986 | Schaeper | E21B 29/02 166/85.4 |
| 10,557,314 | B2 * | 2/2020 | Haavind | B63B 35/4413 |
| 2008/0302530 | A1 * | 12/2008 | Shampine | E21B 33/068 166/381 |
| 2008/0302542 | A1 * | 12/2008 | Pessin | E21B 33/068 166/386 |
| 2017/0204717 | A1 * | 7/2017 | Fox | E21B 47/00 |
| 2017/0314369 | A1 * | 11/2017 | Rosano | G06V 20/52 |
| 2017/0321490 | A1 * | 11/2017 | Haavind | E21B 15/02 |
| 2018/0038188 | A1 * | 2/2018 | Shampine | E21B 33/068 |

* cited by examiner

*Primary Examiner* — Shane Bomar
(74) *Attorney, Agent, or Firm* — ArentFox Schiff LLP

(57) ABSTRACT

A blow out preventor (BOP) stump test apparatus includes: a main body including an outer surface, a bore, and a mounting structure for releasably and rigidly connecting the main body to a BOP to be tested; and a test bar including a position indicator slidably retained in the bore and capable of moving up and down in the bore between an upper position and a lower position, where the positional indicator indicates when the test bar moves up in the bore during a BOP stump test.

15 Claims, 7 Drawing Sheets

BOP STUMP TEST APPARATUS

CROSS-REFERENCE TO RELATED APPLICATION(S)

This application claims priority of U.S. Provisional Application No. 63/066,441 entitled "BOP STUMP TEST APPARATUS" and filed on Aug. 17, 2020, the disclosure of which is expressly incorporated by reference herein in its entirety.

TECHNICAL FIELD

The present disclosure is directed to a blow out preventor (BOP) test apparatus.

BACKGROUND

A blow out preventor (BOP) is a mechanical device used to seal oil and gas wells in the event of an unexpected change in pressure or equipment malfunction. A BOP stack is a series of opposing hydraulic rams arranged perpendicular to the wellbore casing that are able to hold workstrings in place, seal around the outside surface of the workstring, cut the workstring off, and seal the entire wellbore off to prevent the uncontrolled release of crude oil or natural gas. They are usually installed on top of a wellhead.

There is a requirement that the BOP be function tested before it is installed on a well. The function test, known in the field as a 'stump test', involves actuating each set of opposing hydraulic rams fully to ensure that each can close and reopen followed by a pressure test of the body and internal seals. When testing the pipe seals (the seals that seal around the outside surface of the workstring), a test bar is typically used. The test bar must be gripped in the pipe slips to prevent it being forced out of the bop due to hydraulic forces resulting from pressure in the BOP below the test bar.

Occasionally, during a test of the pipe seals, the slips used to grip the test bar are ineffective and the test bar may suddenly be ejected from the BOP. The axial force on a 2⅝" diameter test bar during a stump test could be as high as 81,137 lbs. If the gripping surfaces of the slips within the BOP are plugged with debris, damaged, or the test bar is worn, it is not uncommon for the slips to allow the test bar to move suddenly.

Fatalities have occurred when workers have been struck with an inadequately restrained test bar.

Prior art BOP stump test equipment typically contains a lower flange or blind hand union that incorporates a pressure seal that the bottom connection of the BOP can be attached to and may have provisions to attach a test bar to the bottom. The disadvantage of this design is that movement of the test bar is inhibited by the test equipment and not the BOP slips. Testing conducted with this type of apparatus can only test the BOP's ability to seal but not the BOPs ability to hold the workstring in place.

More often, the test bar consists of a piece of solid bar of the appropriate diameter with a metal ring welded to the top end. The test bar is inserted from the top of the BOP and is restrained within the BOP using transport chains running through the metal ring.

An alternative embodiment of the test bar involves manufacturing the test bar with a larger diameter upset on the lower end known as a 'no-go'. The idea is that, should the test bar move during the BOP pressure test, the no-go will hit the bottom of the BOP slip rams and prevent the test bar from being ejected from the BOP. While this arrangement is effective, it still allows the test bar to move several inches before it is stopped. BOP rams may also be damaged from the resulting shock load from impact with the no-go. There has been at least one fatality associated with this style of test bar where a worker's head was positioned above the test bar when it slipped unexpectedly.

There is a requirement in the industry for a safe and convenient apparatus to pressure test blow out preventors in field locations and at repair facilities.

SUMMARY

The present disclosure pertains to an apparatus for safely stump testing BOPs. The apparatus is designed for use in field applications and repair facilities alike.

In accordance with a broad aspect of the present disclosure, there is provided a BOP stump test apparatus including: a main body including an outer surface, a bore, and a mounting structure for releasably and rigidly connecting the main body to a BOP to be tested; and a test bar including a position indicator slidably retained in the bore and capable of moving up and down in the bore, where the position indicator indicates when the test bar moves up in the bore during a BOP stump test.

In accordance with another broad aspect of the present disclosure, there is provided a method for stump testing a BOP comprising: providing a BOP stump test apparatus including: a main body including an outer surface, a bore, and a mounting structure for releasably and rigidly connecting the main body to a BOP to be tested; and a test bar including a position indicator slidably retained in the bore and capable of moving up and down in the bore, where the position indicator indicates when the test bar moves up in the bore during a BOP stump test; inserting the test bar down through the BOP and closing a BOP element on the test bar; coupling the main body on top of the BOP with the test bar in a lower position in the bore; applying pressure in the BOP below the test bar; and monitoring the position indicator to determine if the test bar moves up in the bore.

Unlike other improvised BOP test equipment, the apparatus described in this disclosure safely contains the test bar within the BOP while allowing the pipe slips to restrain the test bar, allows for detection of test bar movement, and can be used to move the BOP onto the test stump.

It is to be understood that other aspects of the present disclosure will become readily apparent to those skilled in the art from the following detailed description, wherein various embodiments of the disclosure are shown and described by way of illustration. As will be realized, the present disclosure is capable of other and different embodiments and its several details are capable of modification in various other respects, all within the present disclosure. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present disclosure are illustrated by way of example, and not by way of limitation, in detail in the figures, wherein.

DETAILED DESCRIPTION OF THE DRAWINGS

Figure 1:
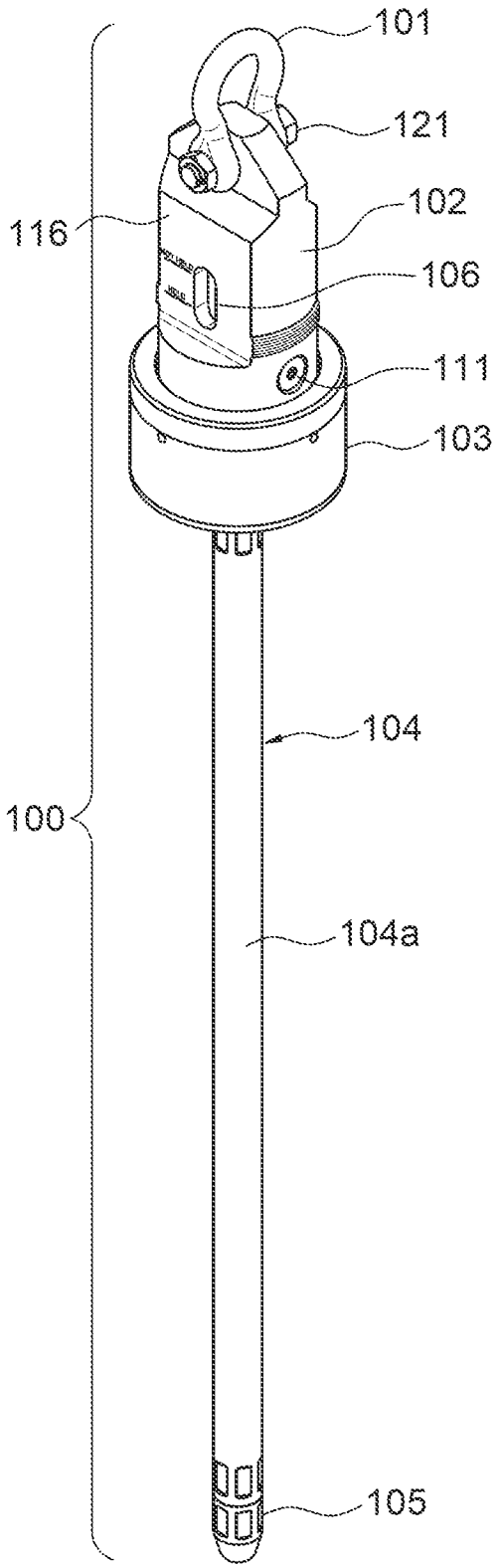
FIG. 1 is an isometric view of one embodiment of the present disclosure.

The detailed description set forth below in connection with the appended drawings is intended as a description of various embodiments of the present disclosure and is not intended to represent the only embodiments contemplated by the inventors. The detailed description includes specific details for the purpose of providing a comprehensive understanding of the present disclosure. However, it will be apparent to those skilled in the art that the present disclosure may be practiced without these specific details.

FIGS. 1 to 5 show an embodiment of a BOP stump test apparatus 100 that includes a main body 102 and a test bar 104. The apparatus further includes a clevis 101 secured by a pin 121 on the main body, which can be used for lifting the apparatus and positioning with respect to the BOP. The main body includes an outer surface 116, a window 106 and a mounting structure such as a barrel nut 103. The mounting structure is configured to releasable but rigidly restrain the stump test apparatus, particularly the main body, in position on the BOP during use. The mounting structure may be coupled directly or indirectly to the BOP, for example, its upper end housing or a structure connected thereto. In one aspect, the mounting structure may be configured for threaded coupling relative to the BOP such as having threads thereon or by bolted coupling. Barrel nut 103 is used to couple the stump test apparatus 100 to the BOP in this embodiment of the present disclosure. Of course, it is to be understood that the apparatus could be attached to the BOP using a flange face for receiving bolted connection or other mounting structure, rather than the barrel nut of a hand union as shown in the Figures. In one aspect, the mounting structure may be configured for threaded coupling relative to the BOP such as direct threaded coupling or by retaining bolts.

The test bar includes a shaft 104*a* and a position indicator 107. The test bar may further include a thread protector 105 on the shaft at an end opposite the position indicator. Position indicator 107 moves with the shaft of the test bar. The position indicator is slidably installed within the main body 102 and is visible, as it moves between a lower position and an upper position, through the window 106.

The stump test apparatus 100 is intended during use to be installed with the test bar shaft inserted down through the BOP slips and seals and with the main body exposed on the top of the BOP. The apparatus is installed with the mounting structure rigidly but releasably secured to the BOP housing and the test bar in a lower position within the main body. During a test, the test bar is subjected to pressure from below and any movement of the test bar upwardly, which may be indicative of a BOP test failure, is evident by observing the location of the position indicator 107 of the test bar through the window 106.

Figure 3:
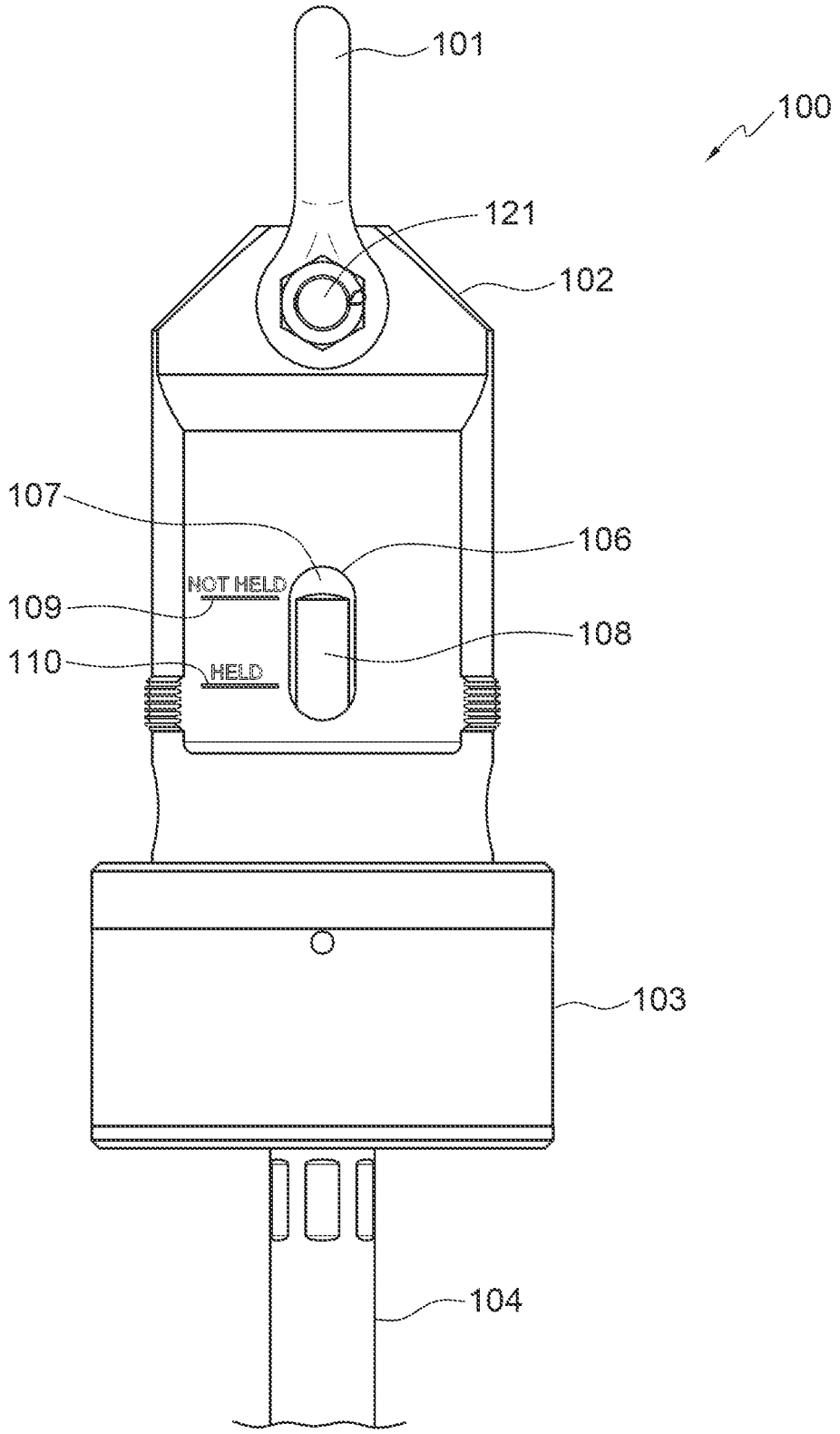
FIG. 3 is partial view of the embodiment shown in FIG. 1, which depicts the position indicator and a portion of the test bar in the upper position as if the slips did not hold the test bar in place during a pressure test.
Figure 4:
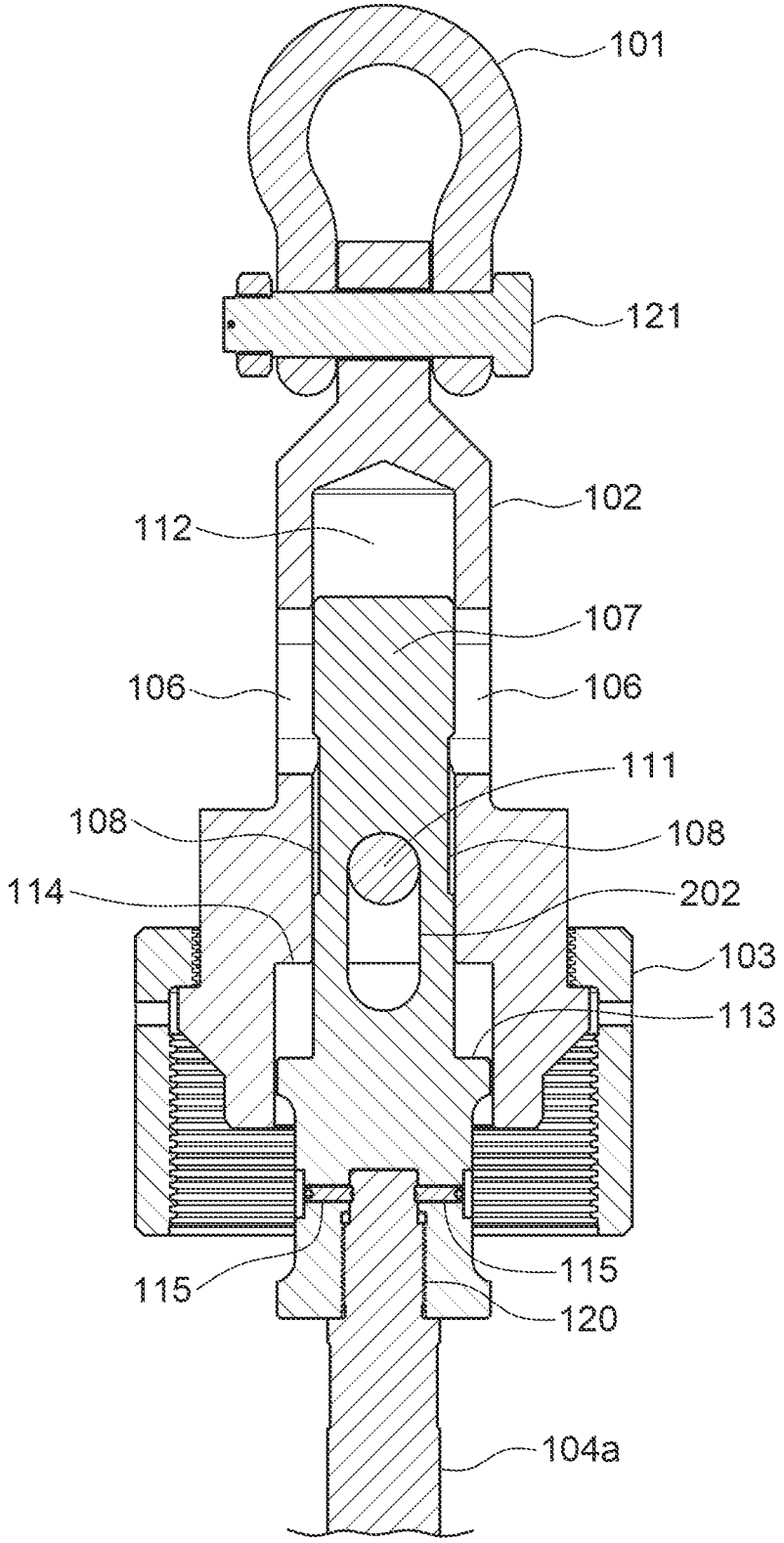
FIG. 4 is a cross section view of the embodiment shown in FIGS. 1 and 2, which depicts the position indicator and a portion of the test bar in the lower position as if the slips held.
Figure 5:
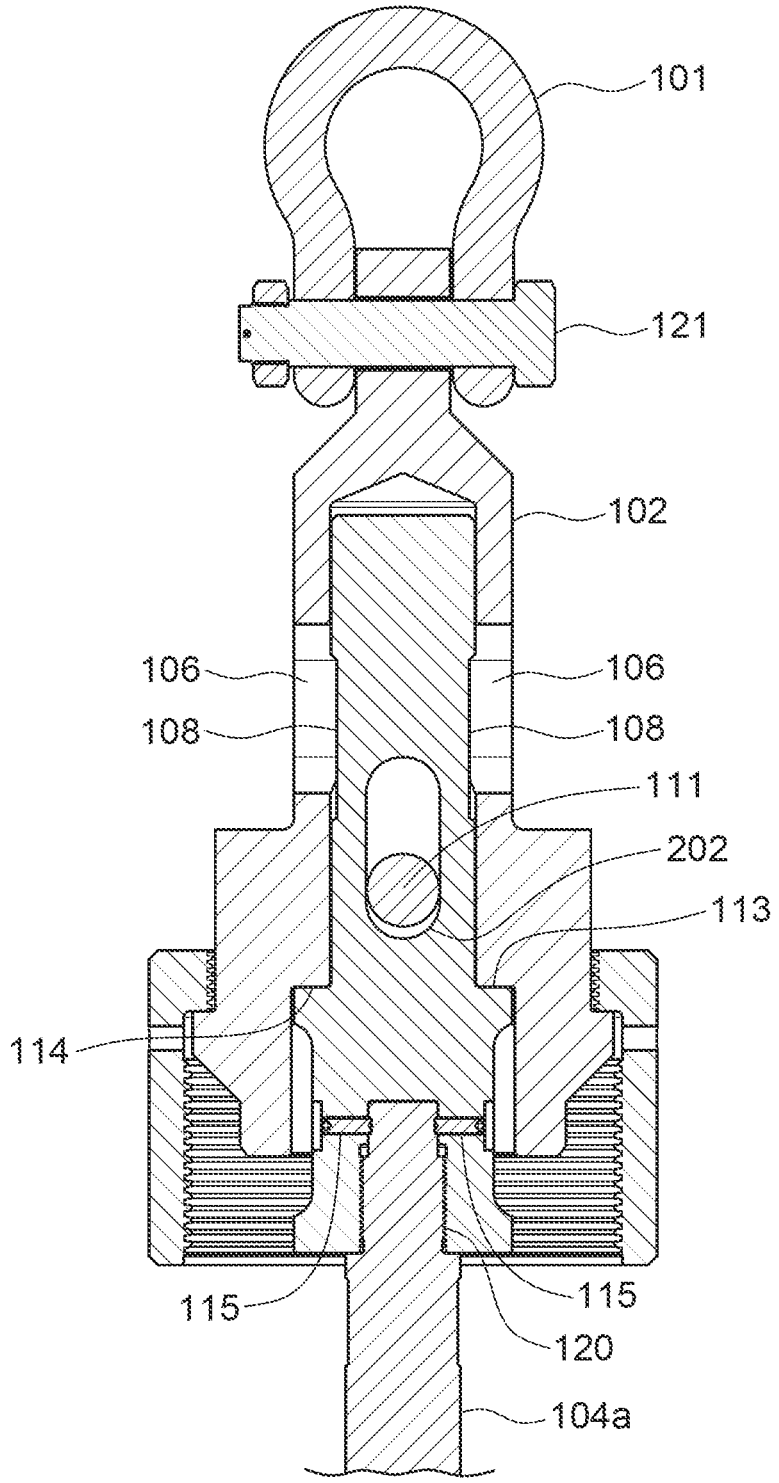
FIG. 5 is a cross section view of the embodiment shown in FIGS. 1 and 3, which depicts the position indicator and a portion of the test bar in the upper position as if the slips did not hold the test bar in place during a pressure test.

FIGS. 2 to 5 are enlarged views of the upper part of the stump test apparatus showing the position indicator 107 with an indicating element 108 that is visible within and through the window 106. The indicating element 108 is anything that can be seen readily, such as for example, a brightly coloured or reflective surface, an applied element such as paint or sticker, or a powered indicator such as a light. Position indicator 107 is engaged, but slidably moveable within a bore 112 of main body. In one embodiment, for example, a retaining pin 111 is used to hold position indicator 107 slidably within the bore and to prevent position indicator 107, and thereby test bar 104, from falling out of the main body 102. In such an embodiment, pin 111 can pass through a slot 202 on the position indicator such that it is slidably affixed within bore 112. Slot 202 has a length and pin 111 is positioned within bore 112 such that the sliding movement of position indicator 107 within the main body is permitted but limited between a lower position (FIG. 4) and an upper position (FIG. 5). The position indicator may have a length whereby it extends up into the bore beyond the upper limit of window 106 even when in the lower position. As such, the top of the position indicator 107 is not exposed within the window 106 in any sliding position, which reduces the potential for a pinch point and resulting hand injuries. Position indicator 107 moves with the shaft of the test bar.

The position indicator 107 has a shoulder 113 positioned to impact a mating surface 114 within the main body 102 to stop upward movement of the position indicator within the bore. Thus, in the event of the BOP slips allowing sudden movement of the test bar up under pressure, this feature prevents shock loading to the load bearing portions of the main body and test bar, for example, during subsequent operations. In an alternative aspect, the apparatus includes a shock absorber to dampen shocks occurring when the position indicator reaches its upper or lower positions. For example, a rubber ring may be positioned between the shoulder 113 of the position indicator 107 and the mating surface 114 of the main body 102. The purpose of this rubber ring is to act as a shock absorber in the event that the BOP slips do not restrain the test bar 104. Obviously other types of shock absorbers known in the art could be utilized instead to prevent shock loading of the mounting structure such as barrel nut 103.

Optional position indicating marks 109 and 110 on the main body 102 convey the position of the test bar to the user(s). Such indicating marks may, for example, be "Held"/"Not Held" (as shown), "Passed"/"Failed" or the like. Alternatively, the position indicating device could be or include an electrical circuit including one or more indicators such as lights, LEDs or audible signals. There may also or alternatively be one or more position measurement devices including but not limited to a linear variable differential transformer (LVDT), a proximity sensor, a Hall Effect sensor, and a power source.

Figure 2:
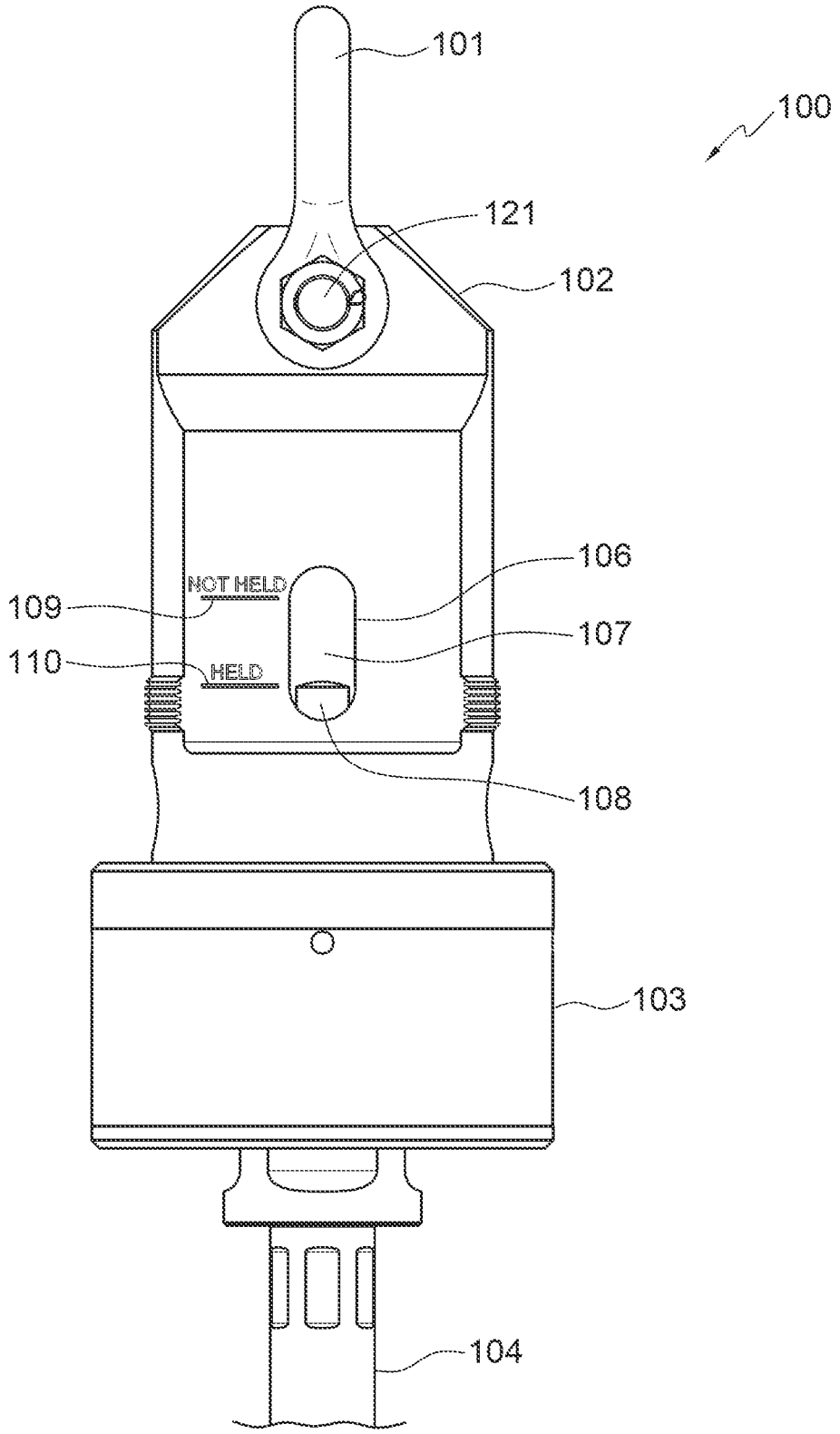
FIG. 2 is partial view of the embodiment shown in FIG. 1, which depicts the position indicator and a portion of the test bar in the lower position as if the slips held.

FIGS. 2 and 4 illustrate the test bar 104 in the lower position as would be the case if the BOP slips held it in place during a pressure test, while FIGS. 3 and 5 illustrate the test bar 104 in an elevated position as would be the case if the BOP slips did not prevent the test bar 104 from moving during a pressure test. Thus, the position indicator 107 in FIG. 2 is depicted in the lower position with the indicating element 108 in a lower position alongside optional mark 110 "held" or not visible within the window 106. In FIG. 3, the indicating element 108 of the sliding position indicator 107 corresponds with the optional position indicating mark 109 on the main body 102 indicating that the test bar 104 was not held by the slips. In other aspects of the present disclosure, the indicating element 108 may not be visible within the window 106 when the test bar 104 is in the lower position.

The test bar may be interchangeable and, as such, may be released from the main body and replaced with another test bar. For example, the test bar shaft may be selected from a number of different diameters (or from other test bars of different diameters) depending on the BOP bore size. Further, the test bar shaft, position indicator and thread protector may be formed integral or coupled in other ways. In one aspect, the shaft is attached to the position indicator using a threaded connection (threads 120 and/or one or more set screws 115). In one aspect, threads 120 that attach the shaft to the position indicator 107 are of the same type as the threads that attach the shaft to the thread protector 105. This allows the shaft to be installed in either direction. This means that if the shaft becomes marred from engagement with the BOP slips, it can be turned and installed upside down so that the marred surface is positioned away from the BOP slips, thus extending the useful life of the test bar. Thus, the test bar can be repositioned as it wears so that a BOP element (a set of actuators such as illustrated in FIGS. 6 and 7) is engaging a different area of the test bar than an area engaged previously during the stump test.

Figure 6:
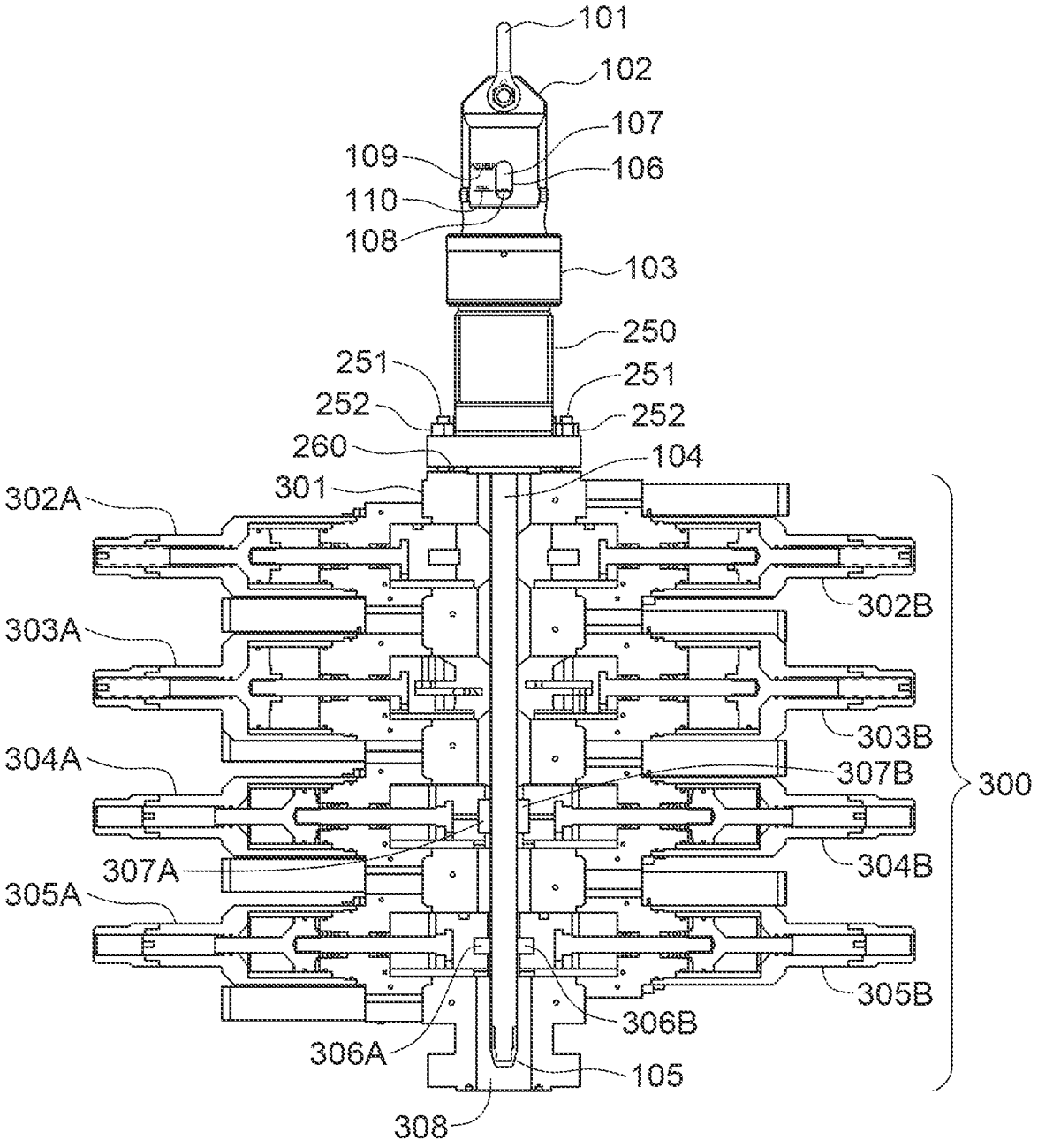
FIG. 6 is a diagram depicting the embodiment shown in FIG. 1 as it would be installed on a quad BOP, where the BOP and associated components are shown as a cutaway for clarity, and which depicts the position indicator and the test bar in the lower position as if the slips held.
Figure 7:
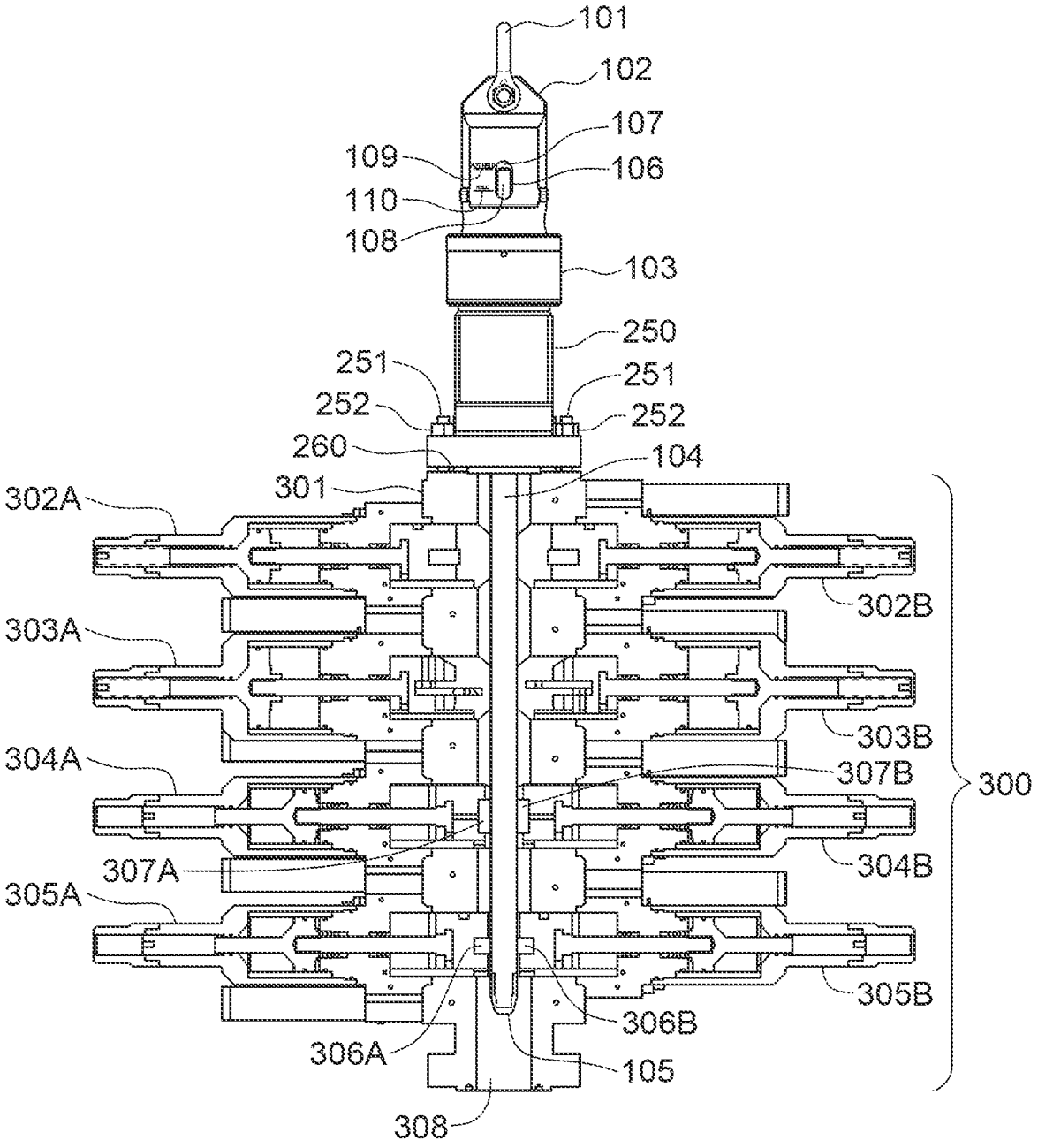
FIG. 7 is a diagram depicting the embodiment shown in FIG. 1 as it would be installed on a quad BOP, where the BOP and associated components are shown as a cutaway for clarity, and which depicts the position indicator and the test bar in the upper position as if the slips did not hold the test bar in place during a pressure test.

FIG. 6 shows the apparatus 100 of FIG. 1 installed atop a BOP 300. The barrel nut 103 fixedly mounts the apparatus to the BOP. For example, in this aspect, barrel nut 103 may be threadably engaged with the top of a crossover 250. The bottom of crossover 250 is installed to the top of the BOP body 301 using studs 251 and nuts 252 and a ring gasket 260.

BOP 300 has a plurality of elements controlled by actuators that move the elements into and out of the BOP bore 308, which extends axially from top to bottom of the BOP. The illustrated BOP, which is depicted as a cutaway for clarity, has four sets of elements controlled by actuators 302A, 302B, 303A, 303B, 304A, 304B, 305A, and 305B to be moved into and out of the BOP bore. BOP 300 may therefore referred to a quad BOP. Each set of actuators (the set of actuators 302A, 302B, the set of actuators 303A, 303B, the set of actuators 304A, 304B, and the set of actuators 305A and 305B) may be individually referred to as a BOP element of the BOP.

The blind seal actuators 302A and 302B, here depicted in the neutral position, contain hydraulic pistons that are designed to engage seals that could seal off the bore 308 of the BOP in the event of an emergency.

The shear actuators 303A and 303B, here depicted in the neutral position, contain hydraulic pistons that are designed to engage shear blades that could cut through a workstring in the event of an emergency.

The pipe seal actuators 304A and 304B, here depicted in the extended position, contain hydraulic pistons that are designed to engage sealing elements 307A and 307B with a work string in the event of an emergency.

The pipe slip actuators 305A and 305B, here depicted in the extended position, contain hydraulic pistons that are designed to engage slips 306A and 306B. The slips 306A and 306B are designed to hold a workstring in place in the event that wellbore pressure is trying to eject the workstring from the wellbore. Similarly, the slips 306A and 306B can be used to hang the workstring in the event that it is sheared off by the shear blades attached to the shear actuators 303A/303B. The slips have semicircular serrated surfaces that are engaged with the workstring using hydraulic forces.

In FIG. 6, the apparatus is in place ready for the stump test. As such, the shaft of the test bar extends down through the BOP bore 308. That is the long axis of the shaft is substantially coaxial with the bore 308. BOP slips 306A and 306B are depicted in engagement with the shaft of test bar 104 as they would be during a stump test. This means that the semicircular serrated surfaces of the slips are engaged with the test bar using hydraulic forces. Further, the pipe seal elements 307A and 307B are sealably engaged with the test bar 104. When conducting a test, pressure is applied to the bottom of the bore 308 of the BOP and the resulting force on the test bar tends to want to push it upwards. The test bar 104 is restrained from upward movement by the BOP slips 306A and 306B.

At the beginning of the test, the user ensures that the main body is secured to the BOP and the test bar is in the lower position, that is with position indicator 107 in its lower position. During the test, the indicating element 108 of the position indicator 107 can be monitored through the window 106 of the main body 102. If it is observed to remain in the lower position, for example with indicating element 108 lined up with the indicating position indicating mark 110 or out of sight, this indicates that the BOP slips 306A, 306B have held the test bar 104 in place as intended. Even in this lower position, however, there is no space exposed in the window, above the position indicator, thus eliminating any pinch points and thereby mitigating a risk of injury.

FIG. 7 shows the apparatus 100 in a condition if the test failed. In particular, after pressure was applied to the bottom of the bore 308 of the BOP 300, the BOP slips 306A and 306B were unable to restrain the test bar 104 from upward movement. As such, the test bar has shifted up while the main body remains mounted in a fixed position on the BOP. The indicating element 108 of the position indicator 107, which can be monitored through the window 106 of the main body 102, is seen to line up with the position indicating mark 109 indicating that the BOP slips 306A, 306B have not held the test bar 104 in place.

Using the apparatus, however, the test bar has a defined range of axial motion limited by the test apparatus, based on parameters of the main body, not the BOP. The force of the test bar moving up in the main body can be accommodated through shoulder 113 bearing against mating surface 114 before the slot 202 hits against pin 111. Thus, movement of the test bar can be limited by interaction with the main body.

From this it will be appreciated that the lower portion of the test bar shaft will be engaged, and perhaps marred by, slips 306A, 306B. If it is desired, the shaft can be removed from position indicator 107 and thread protector 105 and reinstalled in an upside down position.

If desired, the apparatus can be used to support the BOP and, for example, move the BOP onto or off of the well head. For example, a hook can be engaged in clevis 101 while the mounting structure remains engaged to the BOP and then the entire apparatus 100 and BOP 300 can be lifted.

The apparatus of the present disclosure is different that the current stump test solutions because apparatus 100 safely restrains the test bar in the event that the slips are unable to restrain the sudden upward movement of the test bar during a stump test. Other prior art solutions merely use safety chains that are loosely secured to the top of the test bar and wrapped around the BOP. When the test bar moves within the BOP under pressure, the safety chains are subsequently shock loaded, often the test bar becomes bent, and subsequent damage is done to the BOP where the chains are attached. Worse, personnel may be in danger from the movement of the test bar. Thus, the current apparatus mitigates hazards to personnel associated with stump testing BOPs, even relatively simple pinch points. Further, the apparatus can be safely used as a lifting device for positioning BOPs on a stump test fixture or on a wellhead.

The previous description of the disclosed embodiments is provided to enable any person skilled in the art to make or use the apparatus of the present disclosure. Various modifications to those embodiments will be readily apparent to those skilled in the art, and the generic principles defined herein may be applied to other embodiments without departing from the spirit or scope of the present disclosure. Thus, the present disclosure is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC § 112, sixth paragraph, unless the element is expressly recited using the phrase "means for" or "step for".

What is claimed is:

1. A blow out preventor (BOP) stump test apparatus comprising:

a main body including an outer surface, a bore, and a mounting structure for releasably and rigidly connecting the main body to a BOP to be tested; and a test bar including a position indicator slidably retained in the bore and capable of moving up and down in the bore between an upper position and a lower position, wherein the position indicator indicates when the test bar moves up in the bore during a BOP stump test.

2. The BOP stump test apparatus of claim 1 wherein the position indicator indicates when the test bar is installed down through the BOP to be tested and the main body is releasably and rigidly coupled on top of the BOP.

3. The BOP stump test apparatus of claim 1 wherein the main body includes a window between the outer surface and the bore through which a location of the position indicator can be observed.

4. The BOP stump test apparatus of claim 3 wherein the position indicator extends up in the bore beyond the window when in both the lower position and the upper position to eliminate a pinch point.

5. The BOP stump test apparatus of claim 3 wherein the position indicator includes an indicating element for observation through the window.

6. The BOP stump test apparatus of claim 1 wherein the position indicator generates a signal indicative of movement of the test bar up in the bore.

7. The BOP stump test apparatus of claim 1 wherein the mounting structure is configured for threaded coupling on top of the BOP.

8. The BOP stump test apparatus of claim 1 further comprising a threaded connection between the position indicator and a shaft of the test bar such that the shaft is releasably connected to the position indicator for replacement.

9. A method for stump testing a BOP comprising:

providing a BOP stump test apparatus including:

a main body including an outer surface, a bore, and a mounting structure for releasably and rigidly connecting the main body to the BOP to be tested; and a test bar including a position indicator slidably retained in the bore and capable of moving up and down in the bore, wherein the position indicator indicates when the test bar moves up in the bore during a BOP stump test;

inserting the test bar down through the BOP and closing a BOP element on the test bar;

coupling the main body on top of the BOP with the test bar in a lower position in the bore;

applying pressure in the BOP below the test bar; and monitoring the position indicator to determine if the test bar moves up in the bore.

10. The method of claim 9 wherein during the closing, the test bar is held in place with one or more pipe slip actuators of the BOP.

11. The method of claim 9 wherein the monitoring includes observing a location of the test bar through a window on the main body.

12. The method of claim 9 wherein if the test bar moves up in the bore, movement of the test bar is limited by interaction with the main body.

13. The method of claim 9 further comprising interchanging the test bar with other test bars of varying diameters.

14. The method of claim 9 further comprising repositioning the test bar as it wears so that the BOP element is engaging a different area of the test bar than an area engaged previously during a stump test.

15. The method of claim 9 further comprising lifting the main body while the main body remains coupled on top of the BOP, to thereby lift the BOP.

* * * * *